US010106378B2

(12) United States Patent
Aguilar et al.

(10) Patent No.: US 10,106,378 B2
(45) Date of Patent: Oct. 23, 2018

(54) SYSTEM AND METHOD FOR LIFTING WITH LOAD MOVING MACHINE

(71) Applicant: General Electric Company, Schenectady, NY (US)

(72) Inventors: Artemio Josue Aguilar, Querétaro (MX); Robert Allen Baten, Baytown, TX (US); Mario Oscar Ramirez, Querétaro (MX)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 393 days.

(21) Appl. No.: 14/931,834

(22) Filed: Nov. 3, 2015

(65) Prior Publication Data

US 2017/0121161 A1 May 4, 2017

(51) Int. Cl.

| | |
|---|---|
| ***B66C 17/00*** | (2006.01) |
| ***B66C 17/06*** | (2006.01) |
| ***B66C 17/04*** | (2006.01) |

(52) U.S. Cl.

CPC ..... *B66C 17/06* (2013.01); *B66C 17/04* (2013.01)

(58) Field of Classification Search

CPC ..... B66C 17/04; B66C 17/20; B66F 9/0755; B66F 9/07559; B66F 9/122; B66F 9/125; B66F 9/14

See application file for complete search history.

(56) References Cited

U.S. PATENT DOCUMENTS

| | | | | |
|---|---|---|---|---|
| 2,752,056 | A * | 6/1956 | Lull | B66F 9/07559 212/304 |
| 3,532,324 | A * | 10/1970 | Crittenden | B66C 13/06 254/285 |
| 3,662,623 | A | 5/1972 | Lorence | |
| 3,722,627 | A | 3/1973 | Fricke | |
| 3,945,503 | A * | 3/1976 | Cooper | B66C 13/06 212/274 |
| 3,945,504 | A * | 3/1976 | Wright | B66C 13/06 212/274 |
| 4,093,090 | A | 6/1978 | Whiteman | |
| 4,133,437 | A | 1/1979 | Gates | |
| 4,573,663 | A | 3/1986 | Nussbaum | |
| D302,893 | S | 8/1989 | Wakefield | |
| 5,086,704 | A | 2/1992 | Mueller | |
| 5,163,570 | A | 11/1992 | Mundis et al. | |
| 5,176,225 | A | 1/1993 | Nussbaum | |
| 5,199,193 | A | 4/1993 | Akiba et al. | |
| 5,284,224 | A | 2/1994 | Carruth et al. | |

(Continued)

FOREIGN PATENT DOCUMENTS

| | | |
|---|---|---|
| DE | 3615206 | 11/1987 |
| DE | 19741692 | 4/1999 |

(Continued)

OTHER PUBLICATIONS

Extended European Search Report and Opinion issued in connection with corresponding EP Application No. 16204793.0 dated Jun. 26, 2017.

*Primary Examiner* — Emmanuel M Marcelo
(74) *Attorney, Agent, or Firm* — Fletcher Yoder, P.C.

(57) ABSTRACT

A system includes a load moving machine, including a frame and a movable assembly coupled to the frame. The movable assembly includes a lift portion, a rotational portion, a first translational portion, and a second translational portion.

20 Claims, 6 Drawing Sheets

(56) References Cited

U.S. PATENT DOCUMENTS

| | | | |
|---|---|---|---|
| 6,170,350 | B1 | 1/2001 | Behm |
| 6,189,712 | B1 | 2/2001 | Conrad et al. |
| 6,349,793 | B1 | 2/2002 | Kincaid |
| 6,588,814 | B2 | 7/2003 | Miyazawa |
| 6,772,997 | B2 | 8/2004 | Keaton et al. |
| 6,880,416 | B2 | 4/2005 | Koch |
| 7,014,012 | B2 | 3/2006 | Baker |
| 7,284,744 | B1 | 10/2007 | Lerchenmueller et al. |
| 7,383,906 | B2 | 6/2008 | Sewell |
| 8,083,034 | B2 | 12/2011 | Bordwell et al. |
| 8,308,000 | B2 | 11/2012 | Wiesbauer |
| 8,480,349 | B2 | 7/2013 | Hiltscher |
| 8,523,146 | B2 | 9/2013 | Polins et al. |
| 8,800,724 | B1 | 8/2014 | Foster |
| 8,801,354 | B2 | 8/2014 | Lettau |
| 8,893,905 | B2 | 11/2014 | Stuhrwoldt |
| 9,004,103 | B2 | 4/2015 | Foo et al. |
| 2004/0037687 | A1 | 2/2004 | Weiss |
| 2004/0105746 | A1 | 6/2004 | Nolasco |
| 2007/0034125 | A1 | 2/2007 | Lo |
| 2007/0289931 | A1* | 12/2007 | Henriksson ..... B66C 13/063 212/274 |
| 2009/0057636 | A1 | 3/2009 | Davis et al. |
| 2009/0283490 | A1 | 11/2009 | Givens |
| 2011/0099788 | A1 | 5/2011 | Kilibarda |
| 2011/0127229 | A1 | 6/2011 | Laliberte et al. |
| 2012/0067672 | A1 | 3/2012 | Nussbaum |
| 2013/0256611 | A1 | 10/2013 | Ruth sen. |
| 2015/0110582 | A1* | 4/2015 | Jacobsen ..... B66C 13/02 414/141.6 |

FOREIGN PATENT DOCUMENTS

| | | | |
|---|---|---|---|
| DE | 10355946 | | 7/2005 |
| EP | 0064958 | | 11/1982 |
| EP | 0860395 | | 8/1998 |
| EP | 1378480 | | 1/2004 |
| EP | 1408000 | | 4/2004 |
| EP | 1426275 | | 6/2004 |
| EP | 1447372 | | 8/2004 |
| EP | 1 930 289 | A2 | 6/2008 |
| EP | 2465809 | | 6/2012 |
| EP | 2508417 | | 10/2012 |
| EP | 3 034 450 | A1 | 6/2016 |
| GB | 1470095 | | 4/1977 |
| GB | 2287004 | | 9/1995 |
| GB | 2411384 | | 8/2005 |
| WO | 00/34100 | A1 | 6/2000 |
| WO | 2013174935 | | 11/2013 |

* cited by examiner

SYSTEM AND METHOD FOR LIFTING WITH LOAD MOVING MACHINE

BACKGROUND OF THE INVENTION

The subject matter disclosed herein relates to lifting of loads, such as heavy machinery.

A variety of industrial and commercial applications may use heavy machinery, such as generators and turbomachinery (e.g., turbines, compressors, and pump). The heavy machinery may be moved for many reasons, such as initial installation, servicing, or replacement. Unfortunately, the heavy machinery may be installed in locations that are difficult to access, moving or instable, and/or lack space for cranes. For example, the heavy machinery may be installed in ships. The heavy machinery also may be difficult to move due to variations in weight, size, shape, center of gravity, or other characteristics. As a result, the heavy machinery may be difficult to move.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a load moving machine, including a frame and a movable assembly coupled to the frame. The movable assembly includes a lift portion, a rotational portion, a first translational portion, and a second translational portion.

In a second embodiment, a system includes a load moving machine including a movable assembly coupled to a frame. The movable assembly includes a spreader bar coupled having one or more load couplings, a lift portion coupled to the spreader bar, a rotational portion coupled to the lift portion, a first translational portion, and a second translational portion. The lift portion includes a first drive configured to raise and lower the spreader bar in a vertical direction. The rotational portion includes a second drive configured to rotate the lift portion and the spreader bar. The first translational portion includes a third drive configured to translate the rotational portion, the lift portion, and the spreader bar in a first horizontal direction. The second translational portion includes a fourth drive configured to translate the rotational portion, the lift portion, and the spreader bar in a second horizontal direction crosswise to the first horizontal direction.

In a third embodiment, a method includes controlling movement of a lift portion, a rotational portion, a first translational portion, and a second translational portion of a movable assembly coupled to a frame of a load moving machine to move a load.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
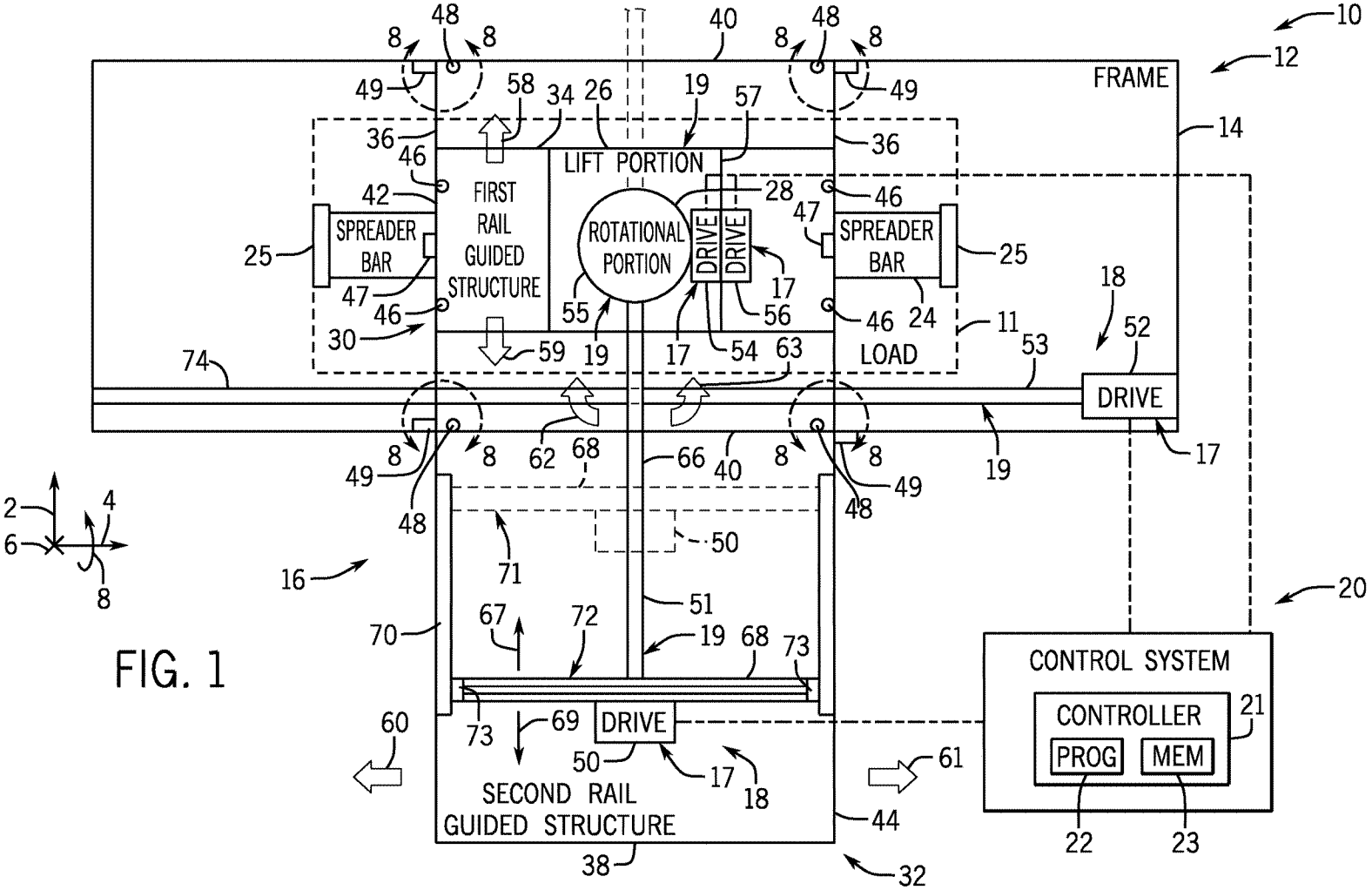
FIG. 1 is a schematic view of an embodiment of a load moving system having a load moving machine with a moveable assembly disposed in a frame, wherein the moveable assembly has a lift portion, a rotational portion, a first translational portion with a first rail guided structure, and a second translational portion with a second rail guided structure.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed toward load moving systems that facilitate movement of a load (e.g., heavy machinery) with at least four degrees of freedom while stabilizing (e.g., balancing) the load. For example, the load may include turbomachinery (e.g., a turbine, a compressor, or a pump), a generator, or a reciprocating internal combustion engine. As discussed in detail below, embodiments of the load moving systems may enable horizontal movement in first and second crosswise directions via respective first and second rail guided structures, vertical movement via a lift portion, and rotational movement via a rotational portion. Altogether, these systems enable four degrees of freedom with controlled movement and stability to ensure protection of the load and the surrounding structures (e.g., deck of a ship).

The first and second rail guided structures may be movably coupled to first and second pairs of rails disposed in a frame, wherein each rail guided structure may include a plurality of wheels (e.g., horizontal and vertical wheels) disposed in each of the rails. In some embodiments, the first rail guided structure may be movably mounted in the second rail guided structure. For example, the second rail guided structure may include the first rails supporting the wheels of the first rail guided structure. The second rail guided structure may be movably mounted in the frame. For example, the frame may include the second rails supporting the wheels of the second rail guided structure. The first and second rail guided structures may be coupled to a drive system (e.g., electric or fluid drive). For example, the drive system may include a liquid or gas driven piston and shaft assembly, an electrical motor driven shaft, a rack and pinion system, a rotary screw system, or any combination thereof. The first rail guided structure may also include the rotational portion, the lift portion, and a spreader bar configured to couple to the load.

The rotational portion may include a drive system (e.g., electric or fluid drive) configured to rotate a first portion relative to a second portion, wherein the first portion is a rotary portion and the second portion is a stationary portion. For example, the first and second portions may be coaxial or concentric with one another, and the drive system may be configured to rotate the first portion externally about or internally within the second portion. The first portion also may be coupled to the lift portion and/or the spreader bar. The lift portion may include a telescopic joint having a plurality of concentric sleeves configured to extend and retract relative to one another in response to a drive system (e.g., electric or fluid drive, winch, cable and pulley, etc.). The lift portion may include one or more stabilizing guides, such as first, second, and third stabilizing guides, coupled to a first plate and movable through a second plate. For example, the first stabilizing guide may be disposed in a slot in the spreader bar, while the second and third stabilizing guides may be disposed on opposite sides of the stabilizing guide.

Turning now to the drawings, FIG. 1 is a schematic view of an embodiment of a load moving system 10 configured to move a load 11 in a plurality of translational/linear directions and a plurality of rotational directions (e.g., horizontal directions, vertical directions, and rotational directions about one or more axes). For purposes of this discussion, reference may be made to a first horizontal axis or direction 2, a second horizontal axis or direction 4 disposed crosswise (e.g., substantially perpendicular) to the first axis 2, a vertical axis or direction 6, and a rotational or circumferential direction 8 disposed about the vertical axis 6. As used herein, the terms horizontal and vertical may include some degree of deviation (e.g., 5, 10, 15, 20, 25, or 30 degrees) from horizontal and vertical, and the terms may be used for convenience to indicate that the axes, directions, and/or planes are generally crosswise (e.g., substantially perpendicular) to one another. The load moving system 10 is configured to move the load 11, in a controlled and stabilized manner, in opposite directions along the first horizontal axis 2, the second horizontal axis 4, the vertical axis 6, and the rotational direction 8.

The load moving system 10 may be used in a variety of applications, such as moving the load 11 in a vessel at sea, an automotive assembly line, an industrial plant, a power plant, a chemical plant, or any combination thereof. The load 11 may include turbomachinery (e.g., a turbine, a compressor, or a pump), a generator, a reciprocating internal combustion engine, other heavy machinery, or any combination thereof. The load 11 also may include a vehicle or vehicle components, a vessel, a combustion system, a reactor, or engine support components (e.g., filter units, exhaust stack, lubrication systems, etc.). In certain embodiments, the load 11 may include a gas turbine engine having a compressor section with one or more compression stages, a combustor section with one or more combustors, and a turbine section with one or more turbine stages.

The load moving system 10 includes a load moving machine 12 having a frame 14 supporting a moveable assembly 16. The frame 14 includes a plurality of structural supports extending in the directions 2, 4, and 6, thereby defining a three-dimensional framework around the load 11. The moveable assembly 16 is configured to support, lift, and move the load 11 in the various directions 2, 4, 6, and 8 within and beyond the perimeter of the frame 14. The load moving system 10 includes a drive system 18 coupled to the moveable assembly 16, wherein the drive system 18 comprises a plurality of drives 17 and transmissions 19 configured to drive movement in the various directions 2, 4, 6, and 8.

The drives 17 of the drive system 18 may include an electric drive (e.g., an electric motor), a fluid drive (e.g., a liquid or hydraulic drive and/or a gas or pneumatic drive), or a combination thereof. The fluid drive may include a piston driven assembly having a piston disposed in a cylinder. The transmissions 19 may include a translational or rotational shaft, a gear box or gear assembly, a telescopic assembly having a plurality of concentric sleeves or shafts that extend and retract relative to one another, a cable and pulley system having a winch, a worm gear assembly, a planetary gear assembly, a rack and pinion gear assembly, or any combination thereof. The drive system 18 may include an independent drive 17 and transmission 19 for movement in each of the directions 2, 4, 6, and 8, or the drive system 18 may share drives 17 and/or transmissions 19 for movement in two or more of the directions 2, 4, 6, and 8.

The drive system 18 is coupled to a control system 20, which may include one or more controllers 21 (e.g., electronic controllers) having a processor 22 and memory 23 (e.g., random access memory, read only memory, flash memory, volatile or non-volatile memory, hard drive, etc.). The controllers 21 are configured to store instructions in the memory 23 and execute the instructions via the processor 22 to control operation of the drive system 18. In particular, the controllers 21 may execute instructions to control the drives 17 to balance the load 11 and to provide a stable rate of movement in the directions 2, 4, 6, and 8 based on a size, weight, shape, or other characteristics of the load 11, the stability of the locations (e.g., mounted on a ship), and so forth. For example, the controllers 21 are configured to control the movement of the load 11 via the moveable assembly 16, including a lift portion 26, a rotational portion 28, a first translational portion 30, and a second translational portion 32. The control system 20 may communicatively couple to various sensors throughout the load moving system 10 and use sensor feedback to help improve the movement of the load 11. The sensors may include speed sensors, accelerometers, wind sensors, humidity sensors, vibration sensors, noise or acoustic sensors, force or resistance sensors, load level sensors, load tilt or angle sensors, load weight sensors, location stability sensors (e.g., motion caused by waves), water sensors (e.g., sense rainfall or water in vicinity of lifting area), or any combination thereof. The control system 20 also may include a user interface or control panel having a display (e.g., LED, LCD, or touch screen display), user inputs (e.g., buttons, keypad or keyboard, touchpad, mouse, etc.), outputs or alerts (e.g., audio or visual alarms), or any combination thereof.

As described in further detail below, the moveable assembly 16 may include a spreader bar 24, the lift portion 26, the rotational portion 28, the first translational portion 30, and the second translational portion 32. The first translational portion 30 may include a first rail guided structure 34 disposed along one or more first rails 36 (e.g., first and second parallel rails 36), while the second translational portion 32 may include a second rail guided structure 38 disposed along one or more second rails 40 (e.g., first and second parallel rails 40). In certain embodiments, the first and second translational portions 30 and 32 (e.g., first and second rail guided structures 34 and 38) may be independent and separate from one another. In the illustrated embodiment, the first and second translational portions 30 and 32 (e.g., first and second rail guided structures 34 and 38) are dependent on one another in a nested arrangement, wherein the first rail guided structure 34 is configured to move along the second rail guided structure 38, while the second rail guided structure 38 is configured to move along the frame 14. As a result, parts of the second rail guided structure 38 support the first rail guided structure 34.

Figure 2:
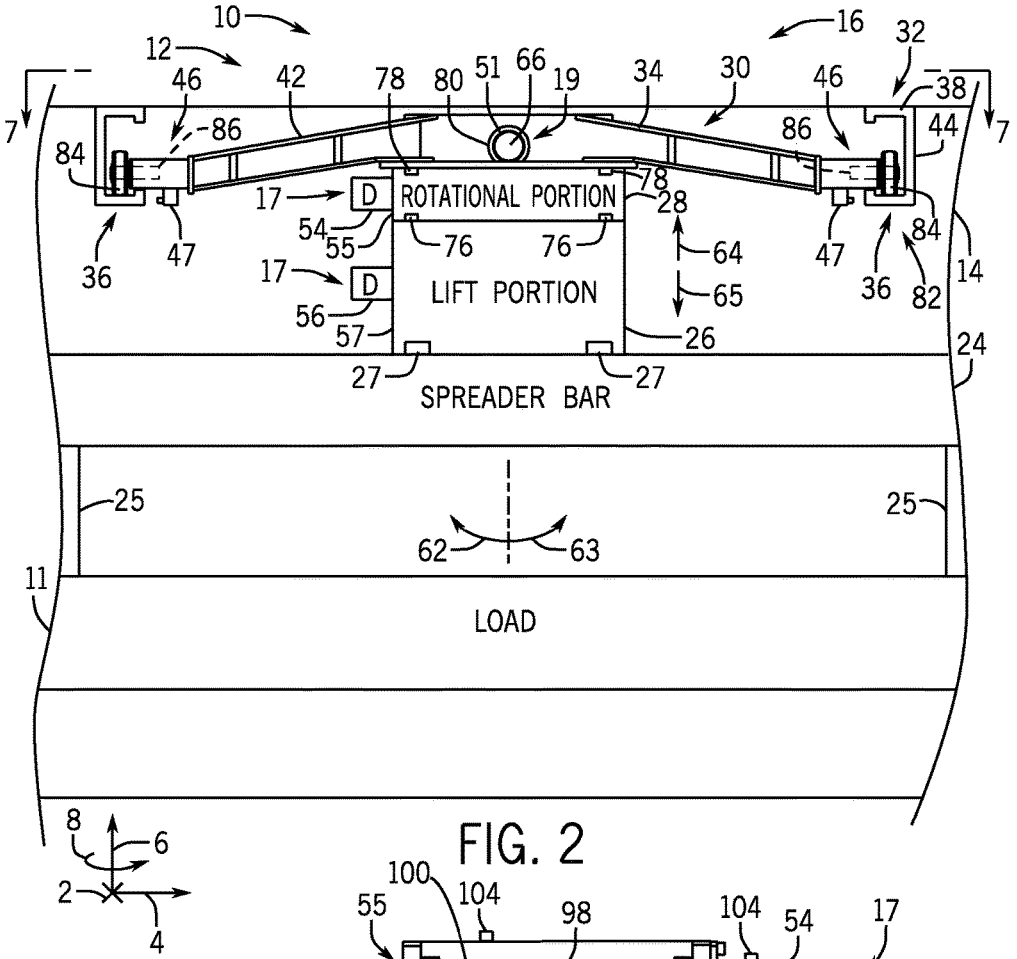
FIG. 2 is a schematic side view of an embodiment of the load moving system of FIG. 1, illustrating the moveable assembly having the rotational portion and the lift portion coupled to a spreader bar, which supports one or more loads.

In the illustrated embodiment, the first rail guided structure 34 includes a first framework or support structure 42 (e.g., a spider trolley), while the second rail guided structure 38 includes a second framework or support structure 44. The first framework 42 of the first rail guided structure 34 supports the load 11, the spreader bar 24, the lift portion 26, and the rotational portion 28, wherein the elements 11, 24, 26, and 28 may be coupled together in any suitable arrangement. For example, the spreader bar 24 may be coupled to the load 11 via one or more load couplings 25, the lift portion 26 may be coupled to the spreader bar 24 via one or more lift couplings 27 (as shown in FIG. 2), the rotational portion 28 may be coupled to the lift portion 26 via one or more couplings and/or stabilizing guides 76 (as shown in FIG. 2), and the rotational portion 28 may be coupled to the first framework 42 via one or more couplings 78 (as shown in FIG. 2). The first framework 42 of the first rail guided structure 34 also includes a plurality of wheels 46 (e.g., horizontal and vertical wheels) configured to roll along the first rails 36 and one or more movable lock assemblies 47 to selectively block movement along the first rails 36. For example, the control system 20 may be coupled to actuator controlled lock assemblies 47 that rotate and/or extend and retract a lock or stop structure between a locked position and an unlocked position relative to the first rails 36. In the illustrated embodiment, the first rails 36 are coupled to, integrated with, and/or part of the second framework 44. For example, parallel beams of the second framework 44 may include a C-shaped cross-section to define the first rails 36. In the illustrated embodiment, the first rails 36 are oriented along or parallel with the first horizontal axis 2. The second framework 44 of the second rail guided structure 38 supports the first rail guided structure 34, and thus supports the load 11, the spreader bar 24, the lift portion 26, the rotational portion 28, and the first framework 42. The second framework 44 of the second rail guided structure 38 also includes a plurality of wheels 48 (e.g., vertical wheels 84 and horizontal wheels 86, as shown in FIG. 2) configured to roll along the second rails 40 and one or more movable lock assemblies 49 to selectively block movement along the second rails 40. For example, the control system 20 may be coupled to actuator controlled lock assemblies 49 that rotate and/or extend and retract a lock or stop structure between a locked position and an unlocked position relative to the second rails 40. In the illustrated embodiment, the second rails 40 are coupled to, integrated with, and/or part of the frame 14. For example, parallel beams of the frame 14 may include a C-shaped cross-section to define the second rails 40. In the illustrated embodiment, the second rails 40 are oriented along or parallel with the second horizontal axis 4. As a result, the first and second rails 36 and 40 are oriented crosswise to one another (e.g., substantially perpendicular to one another) in a horizontal plane.

In certain embodiments, the control system 20 is configured to simultaneously, sequentially, dependently, and/or independently control movement of the moveable assembly 16 via a first drive 17, 50 and a first transmission 19, 51, a second drive 17, 52 and a second transmission 19, 53, a third drive 17, 54 and a third transmission 19, 55, and a fourth drive 17, 56 and a fourth transmission 19, 57. For example, the first drive 17, 50 and the first transmission 19, 51 are drivingly coupled to the first rail guided structure 34 to selectively translate (e.g., linearly move) the first rail guided structure 34 along the first rails 36 in opposite first and second directions 58, 59 along the first horizontal axis 2. By further example, the second drive 17, 52 and the second transmission 19, 53 are drivingly coupled to the second rail guided structure 38 to selectively translate (e.g., linearly move) the second rail guided structure 38 along the second rails 40 in opposite first and second directions 60, 61 along the second horizontal axis 4. By further example, the third drive 17, 54 and the third transmission 19, 55 are drivingly coupled to the rotational portion 28, the lift portion 26, the spreader bar 24, and/or the load 11 to selectively rotate these components 28, 26, and/or 11 in opposite first and second directions 62, 63 about the vertical axis 6. By further example, the fourth drive 17, 56 and the fourth transmission 19, 57 are drivingly coupled to the lift portion 26, the spreader bar 24, and/or the load 11 (and optionally the rotational portion 28) to selectively translate (e.g., linearly move) these components 26, 24, and/or 11 (and optionally 28) in opposite first and second directions 64, 65 (as shown in FIG. 2) along the vertical axis 6. Again, the control system 20 may be configured to control these drives 17 to cause movements simultaneously, sequentially, dependently, and/or independently to provide a desired stable movement of the load 11.

As discussed in detail below, each of the drives 17 and transmissions 19 may have a variety of structures and components to induce movement of the moveable assembly 16 in the desired directions. For example, the first transmission 19, 51 may include an elongated structure 66 (e.g., a threaded shaft) that is threaded into a portion of the first rail guided structure 34 and/or the frame 14, such that rotation of the shaft 66 causes translational motion of the first rail guided structure 34. However, as discussed in detail below with reference to FIGS. 9-11, the first transmission 19, 51 may include a variety of mechanisms to move the first rail guided structure 34 in response to the first drive 17, 50. In the illustrated embodiment, the first drive 17, 50 is coupled to a sliding support structure 68, which is slidingly mounted in and moves linearly along a pair of third rails 70 (or sliding guide supports) in opposite first and second directions 67, 69. In some embodiments, the first drive 17, 50 and the first transmission 19, 51 may be configured to simultaneously translate the first rail guided structure 34 along the first rails 36 while moving the sliding support structure 68 along the third rails 70 (e.g., between a first position 71 shown in dashed lines and a second position 72 shown in solid lines). In the illustrated embodiment, the sliding support structure 68 may first move at least partially or entirely along the length of the third rails 70 from the first position 71 to the second position 72 while the first rail guided structure 34 is locked in position relative to the first rails 36 via the lock assemblies 47. For example, while the sliding support structure 68 is disposed in the first position 71, the control system 20 may selectively actuate the lock assemblies 47 to engage the first rails 36 (e.g., extension of lock structures), thereby securing the first rail guided structure 34 in position. Once the structure 34 is secured in position, the first drive 17, 50 and the first transmission 19, 51 may be configured to rotate the threaded shaft 66 relative to the first rail guided structure 34, thereby driving the sliding support structure 68 from the first position 71 to the second position 72. Once the structure 68 is in the second position 72, the control system 20 may selectively actuate the lock assemblies 47 to disengage the first rails 36 (e.g., retraction of lock structures), thereby releasing and allowing free movement of the first rail guided structure 34 along the first rails 36. In addition, the control system 20 may selectively actuate lock assemblies 73 to engage the third rails 70 (e.g., extension of lock structures), thereby locking and blocking free movement of the sliding support structure 68 along the third rails 70. At this point, the control system 20 may selectively actuate the first drive 17, 50 to rotate the threaded shaft 66 relative to the first rail guided structure 34, thereby driving movement of the first rail guided structure 34 along the first rails 36 in the first direction 59. The control system 20 also may operate the first drive 17, 50, the lock assemblies 47, and the lock assemblies 73 in the reverse order to move the first rail guided structure 34 in the second direction 58. Although a specific controlled procedure has been described for movement of the first rail guided structure 34, any simultaneous or sequential movements of the first rail guided structure 34 and the sliding support structure 68 may be implemented to cause movement of the load 11 coupled to the spreader bar 24.

In certain embodiments, the second transmission 19, 53 may include an elongated structure 74 (e.g., a threaded shaft) that is threaded into a portion of the second rail guided structure 38 and/or the frame 14, such that rotation of the shaft 74 causes translational motion of the second rail guided structure 38. Again, the control system 20 may selectively actuate lock assemblies 49 to engage the second rails 40 (e.g., extension of lock structures) or disengage the second rails 40 (e.g., retraction of lock structures), thereby selectively blocking or enabling free movement of the second rail guided structure 38 along the second rails 40. The lock structures may include a locking peg that selectively moves in and out of a lock housing, thereby extending and retracting the locking peg relative to the respective rails. As discussed in detail below with reference to FIGS. 9-11, the second transmission 19, 53 may include a variety of mechanisms to move the second rail guided structure 38 in response to the second drive 17, 52. Likewise, the third and fourth transmissions 19, 55, 57 also may include a variety of mechanisms to rotate and lift the spreader bar 24, and thus the load 11. Embodiments of these transmissions 19, 55, 57 are shown and described with reference to FIGS. 2-6.

FIG. 2 is a schematic side view of an embodiment of the moveable assembly 16 of FIG. 1, illustrating the load 11 supported by the spreader bar 24 (e.g., coupled via load couplings 25), the spreader bar 24 coupled to the lift portion 26 via lift couplings 27, the rotational portion 28 coupled to the lift portion 26 via one or more couplings 76, and first framework 42 coupled to the rotational portion 28 via one or more couplings 78. The couplings 25, 27, 76, and 78 may include threaded fasteners (e.g., bolts and/or nuts), brackets, hooks that fit into slots, dovetail joints, threaded flanges, clamps, welded joints, or any combination thereof. In the illustrated embodiment, the rotational portion 28 is disposed vertically above the lift portion 26. In some embodiments, the rotational portion 28 is disposed vertically below the lift portion 26. The rotational portion 28 is driven by the drive 17, 54 to cause rotation of the lift portion 26, the spreader bar 24, and the load 11 in opposite directions 62, 63 about the vertical axis 6. The lift portion 26 is driven by the drive 17, 56 to cause vertical movement of the lift portion 26, the spreader bar 24, and the load 11 in opposite vertical directions 64, 65 along the vertical axis 6. The first rail guided structure 34 (including the first framework 42, the rotational portion 28, the lift portion 26, the spreader bar 24, and the load 11) is driven to move along the first rails 36 via the drive 17, 50 and the transmission 19, 51 (e.g., shaft 66, as shown in FIG. 1). For example, the shaft 66 may be coupled to a receptacle 80 (e.g., a threaded receptacle), such that rotation of the shaft 66 causes translation of the first rail guided structure 34 in the first horizontal direction 2 along the first rails 36. The first rails 36 have a C-shaped cross-section 82 (or C-shaped extrusion) configured to support the plurality of first wheels 46, such as a plurality of vertical wheels 84 and a plurality of horizontal wheels 86. The vertical wheels 84 are configured to provide vertical stabilization of the first rail guided structure 34, while the horizontal wheels 86 are configured to provide horizontal stabilization of the first rail guided structure 34.

Figure 3:
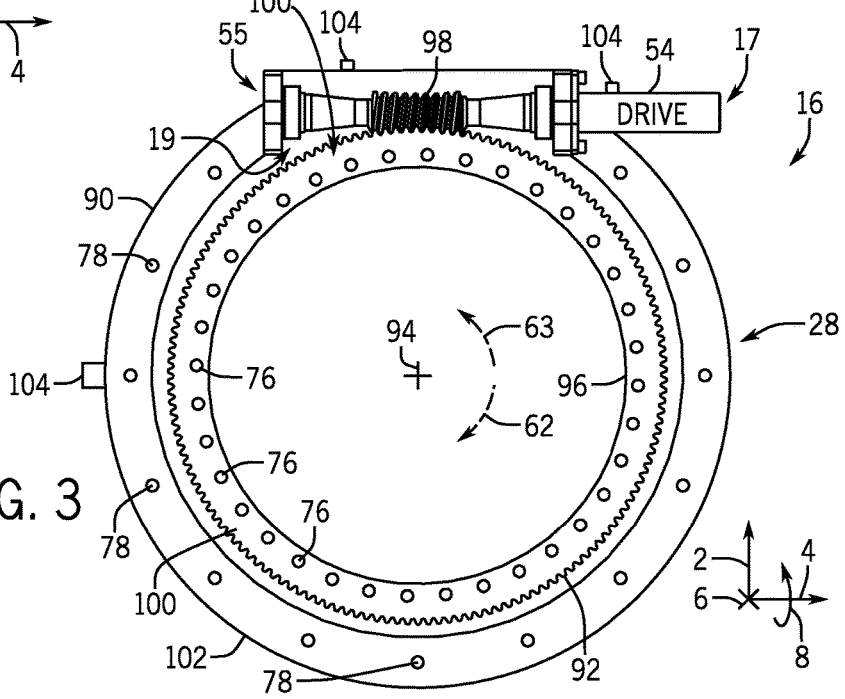
FIG. 3 is a schematic cross-sectional top view of an embodiment of the rotational portion of the moveable assembly of FIGS. 1-2.

FIG. 3 is a perspective view of an embodiment of the rotational portion 28 of the moveable assembly 16 of FIGS. 1-2. As described above, the rotational portion 28 may be coupled to a first framework 42. The rotational portion 28 may include a first portion 90 and a second portion 92 disposed in a nested arrangement, such as a coaxial or concentric arrangement with the portions 90 and 92 disposed about one another and a central axis 94. For example, the first and second portions 90 and 92 may be concentric annular portions, wherein at least one rotates relative to the other. In the illustrated embodiment, the first portion 90 comprises a fixed portion (e.g., a fixed housing or casing) and the second portion 92 comprises a rotational portion. The first and second portions 90 and 92 may be coupled together along an annular rail and/or bearing assembly 96, thereby blocking axial movement while allowing rotational movement between the portions 90 and 92. The first portion 90 (e.g., fixed portion) may be coupled to the first framework 42 via the plurality of couplings 78, which may include threaded fasteners (e.g., threaded receptacles, bolts, nuts, etc.), clamps, rods, receptacles, welds, or any combination thereof. Likewise, the second portion 92 (e.g., rotational portion) may be coupled to the lift portion 26 via the plurality of couplings 76, which may include threaded fasteners (e.g., threaded receptacles, bolts, nuts, etc.), clamps, rods, receptacles, welds, or any combination thereof. In the illustrated embodiment, the third transmission 19, 55 includes a first or drive gear 98 coupled to or integral with the third drive 17, 54, and a second or driven gear 100 coupled to or integral with the second portion 92 (e.g., rotational portion) of the rotational portion 28. For example, the drive gear 98 may include a threaded shaft or worm, while the driven gear 100 may include a worm gear or annular gear having outwardly facing teeth. In operation, the third drive 17, 54 is controlled by the control system 20 to rotate the drive gear 98, which in turn drives rotation of the driven gear 100. As the driven gear 100 rotates, the third transmission 19, 55 drives rotation of the lift portion 26, the spreader bar 24, and the load 11. The first portion 90 may be coupled to the first framework 42 in a fixed or stationary position, while the second portion 92 rotates in response to the third drive 17, 54 and third transmission 19, 55. In response to the control system 20, the second portion 92 of the rotational portion 28 may be driven to rotate in the opposite directions 62 and 63 in a smooth continuous manner, in a stepwise manner (e.g., increments of 0.1, 1, 2, 3, 4, 5, or 10 degrees), or any combination thereof. The range of rotation may be 45, 60, 90, 180, 270, or 360 degrees, or any suitable rotational distance. In some embodiments, the first and/or second portions 90 and 92 may be partially or entirely integrated with, recessed into, or housed by the first framework 42. The first portion 90 may include an outer housing wall 102 (e.g., sealed container) configured to contain and protect the second portion 92, the bearing assembly 96, and the gears 98 and 100, thereby blocking any ingress of debris, water, dirt, and/or other external contaminants. In some embodiments, the first portion 90, the second portion 92, the bearing assembly 96, the wall 102, and/or the third drive 17, 54 may include a lubricant fitting 104 (e.g., a grease fitting) to provide lubricant (e.g., grease) for the rotational components.

Figure 5:
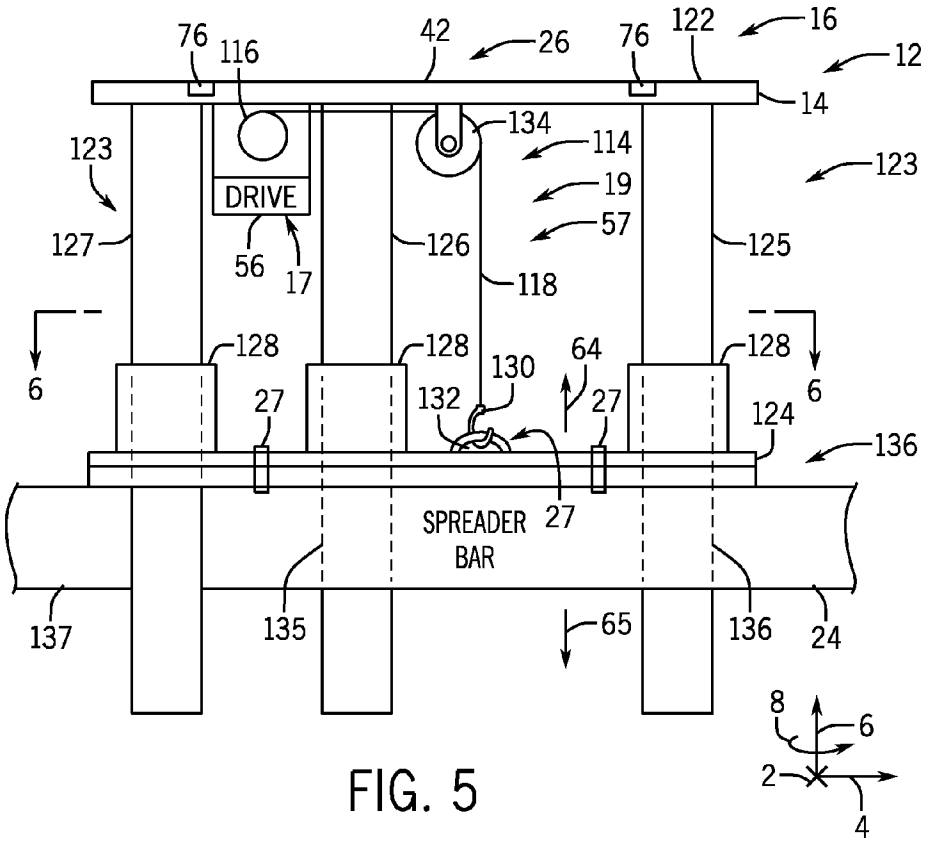
FIG. 5 is a schematic side view of an embodiment of the lift portion of the moveable assembly coupled to the spreader bar of FIGS. 1-2.
Figure 4:
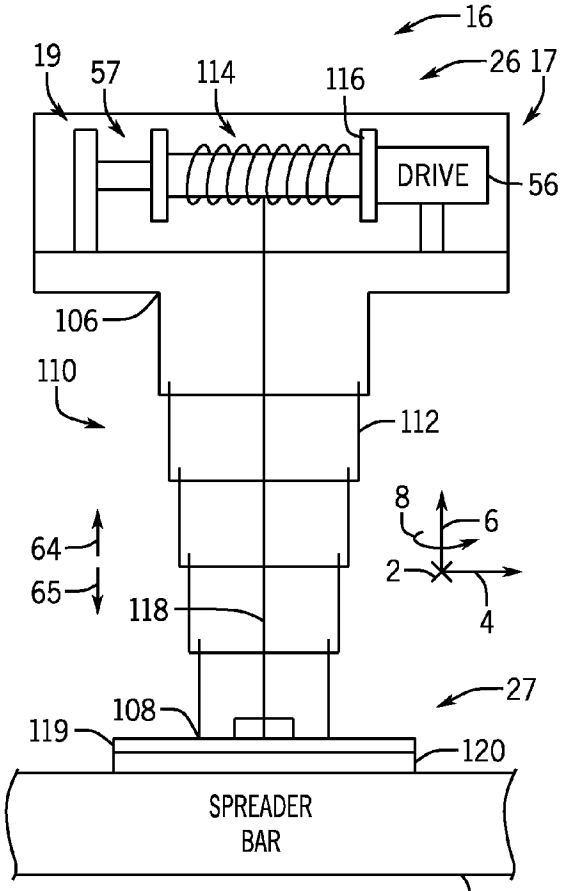
FIG. 4 is a schematic side view of an embodiment of the lift portion of the moveable assembly coupled to the spreader bar of FIGS. 1-2.
Figure 6:
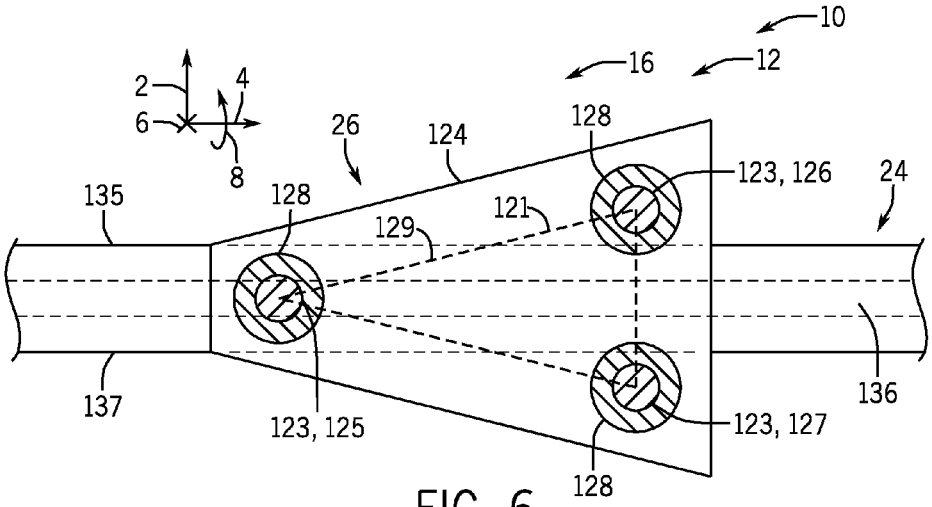
FIG. 6 is a partial cutaway schematic view of an embodiment of the lift portion taken within line 6-6 of FIG. 5, illustrating a first stabilizing guide disposed in a slot of the spreader bar and second and third stabilizing guides disposed on opposite sides of the spreader bar.

FIGS. 4-6 illustrate features of the lift portion 26 of the movable assembly 16. For example, FIG. 4 is a schematic side view of an embodiment of the lift portion 26 of the moveable assembly 16 coupled to the spreader bar 24 of FIGS. 1-2. The lift portion 26 may include a telescopic joint 110 that moves in the vertical direction 6. The telescopic joint 110 may be coupled to the lift portion 26 at a first end 106 by welding, brazing, a flange with connecting members, or any other suitable process. The telescopic joint 110 may include a plurality of concentric sleeves 112 (e.g., 2, 3, 4, 5, 6, 7, 8, 9, 10, or more) arranged concentrically around a longitudinal axis of the telescopic joint 110. Smaller concentric sleeves 112 may be nested within larger concentric sleeves 112 when the telescopic joint 110 is retracted. The concentric sleeves 112 may be cylindrical, square, rectangular, or any other suitable geometry. The concentric sleeves 112 may axially extend and retract relative to one another to translate the load 11 in the vertical direction 6. The concentric sleeves 112 may extend and retract in the vertical direction 6, in opposite directions 64 and 65 to translate the load 11 to various positions in response to the control system 20. The concentric sleeves 112 also may be sized (e.g., diameter, wall thickness, etc.) and spaced (e.g., clearance) to improve stability while lifting and lowering the load 11. For example, the concentric sleeves 112 may generally block laterally movement of the lift portion 26 and the load 11 in the horizontal directions 2 and 4. Mechanical stops or protrusions may be disposed around the sides of the concentric sleeves 112 to control the extension and retraction of the concentric sleeves when they are translated. The inner and outer surfaces of the concentric sleeves 112 may be coated with a material such as grease to reduce the effect of friction between the concentric sleeves 112 when concentric sleeves move relative to one another. The fourth drive 17, 56 and fourth transmission 19, 57 may be utilized to translate the telescopic joint 110 in the vertical direction 6. The fourth transmission 19, 57 may include a variety lifting assemblies, such as an electrical chain hoist, an electrical wire rope hoist, a hydraulic winch, or other suitable lifting mechanism to lift and/or lower the load 11. For example, the fourth transmission 19, 57 may include a hoist or winch system 114 having a spool 116 coupled to the fourth drive 17, 56, and a line 118 coiled around the spool 116 and coupled to the spreader bar 24 at the coupling 27 (e.g., lift coupling). The line 118 may include a cable, a chain, a rope, or any combination thereof, made of metal, fabric, plastic, etc. The coupling may include a plurality of mounting flanges or plates, such as a first plate 119 coupled to the end 108 of the telescopic joint 110 and a second plate 120 coupled to the spreader bar 24. The plates 119, 120 may be coupled together via threaded fasteners, welds, clamps, or any suitable joints.

FIG. 5 is a schematic side view of an embodiment of the lift portion 26 of the moveable assembly 16 coupled to the spreader bar 24 of FIGS. 1-2. As described above, the rotational portion 28 may include the first portion 90 and the second portion 92, wherein the second portion 92 may be coupled to the lift portion 26 via the plurality of couplings 76 (e.g., threaded fasteners, hooks, clamps, welds, etc.). In the illustrated embodiment, the lift portion 26 includes opposite first and second plates 122 and 124 (e.g., upper and lower supports), which are spaced apart from one another in a substantially parallel arrangement and move toward and away from one another via the fourth drive 17, 56 and fourth transmission 19, 57. The first plate 122 is coupled to the second portion 92 of the rotation portion 28 via the couplings 76, while the second plate 124 is coupled to the spreader bar 24 via the couplings 27 (e.g., threaded fasteners, hooks, clamps, welds, etc.).

The lift portion 26 also includes a plurality of stabilizing guides 123 (e.g., vertical stabilizing guides), such as first, second, and third stabilizing guides 125, 126, and 127 coupled to the first plate 122. For example, the stabilizing guides 123 may be coupled to the first plate 122 via fixed couplings (e.g., welded joints or one-piece construction), removable couplings (e.g., threaded joints, threaded fasteners, clamps, hooks, etc.), or any combination thereof. The stabilizing guides 123 may be vertically oriented shafts, rods, or structural supports, which generally extend along the vertical axis 6 in a parallel orientation relative to one another and a crosswise (e.g., perpendicular) orientation relative to the first and second plates 122, 124. The stabilizing guides 123 also may be offset from one another in a stabilizing arrangement 121, such as a triangular arrangement (as shown in FIG. 6).

In the illustrated embodiment, the second plate 124 is configured to move in opposite vertical directions 64, 65 along a length of the stabilizing guides 123. For example, the second plate 124 includes a plurality of stabilizing guide supports or receptacles 128 (e.g., annular supports with bores), which are configured to receive the plurality of stabilizing guides 123 (e.g., stabilizing guides 125, 126, and 127). The stabilizing guides 123 are configured to slide in the vertical directions 64, 65 through the receptacles 128 during lifting and lowering. The stabilizing guides 123 and receptacles 128 may be cylindrical, elliptical, square, rectangular, or any other polygonal shape. In the illustrated embodiment, the stabilizing guide supports or receptacles 128 may be coupled to the second plate 124 via fixed couplings (e.g., welded joints or one-piece construction), removable couplings (e.g., threaded joints, threaded fasteners, clamps, hooks, etc.), or any combination thereof. The illustrated stabilizing guide supports or receptacles 128 also protrude from the second plate 124 to provide a greater length and stability for the stabilizing guides 123 received therein. For example, the stabilizing guide supports or receptacles 128 may include bushings, sleeves, cylindrical bearings, or any combination thereof. The stabilizing guide supports or receptacles 128 also may be offset from one another in a stabilizing arrangement 129 (as shown in FIG. 6), such as a triangular arrangement, to match the stabilizing arrangement 121 of the stabilizing guides 123.

As depicted, one or more of the stabilizing guides 123 may be disposed in the spreader bar 24 through a spreader bar slot 136, which extends lengthwise along the spreader bar 24 (e.g., along a centerline). For example, the spreader bar 24 may include 1, 2, 3, 4, 5, 6, or more spreader bar slots 136 that receive corresponding stabilizing guides 123. In the illustrated embodiment, the first stabilizing guide 123, 125 is disposed in the spreader bar slot 136, while the second stabilizing guide 123, 126 and the third stabilizing guide 123, 127 are disposed on opposite first and second sides 135 and 137 of the spreader bar 24. The placement of the stabilizing guides 123 both internally within the slot 136 of the spreader bar 24 and externally along the sides 135, 137 of the spreader bar 24 helps to provide additional stability during lifting and lowering of the spreader bar 24 and the load 11. The stabilizing guides 123 may extend a partial depth, a complete depth, or greater than the complete depth of the spreader bar 26 to provide stability. Moreover, the first stabilizing guide 123, 125 and the second stabilizing guide 123, 126 can slide relative to spreader bar slot 136 on axis 4 so that is centered to different loads 11 center of gravity.

In the illustrated embodiment, the control system 20 is configured to selectively operate the fourth drive 17, 56 and fourth transmission 19, 57 to raise and lower the second plate 124 with receptacles 128, the spreader bar 24, and the load 11, while the first plate 122 and the stabilizing guides 123 generally remain stationary (e.g., no vertical movement). During this movement, the stabilizing guide supports or receptacles 128 of the second plate 124 slide up and down the stabilizing guides 123, while the spreader bar 24 slides up and down the stabilizing guides 123 at the spreader bar slot 136 and opposite sides 135 and 137 of the spreader bar 24. In this manner, the stabilizing guides 123 provide stability and lateral support, thereby resisting lateral movement, tilt, or pivoting away from the vertical axis 6. The fourth transmission 19, 57 may include a variety lifting assemblies, such as an electrical chain hoist, an electrical wire rope hoist, a hydraulic winch, or other suitable lifting mechanism to lift and/or lower the load 11. For example, the fourth transmission 19, 57 may include a hoist or winch system 114 having a spool 116 coupled to the fourth drive 17, 56, and a line 118 coiled around the spool 116 and coupled to the spreader bar 24 at the coupling 27 (e.g., lift coupling such as a hook 130 in a receptacle 132). The line 118 may include a cable, a chain, a rope, or any combination thereof, made of metal, fabric, plastic, etc. The hoist or winch system 114 also may include one or more pulleys 134 to route the line 118 from the spool 116 to the coupling 27.

Figure 7:
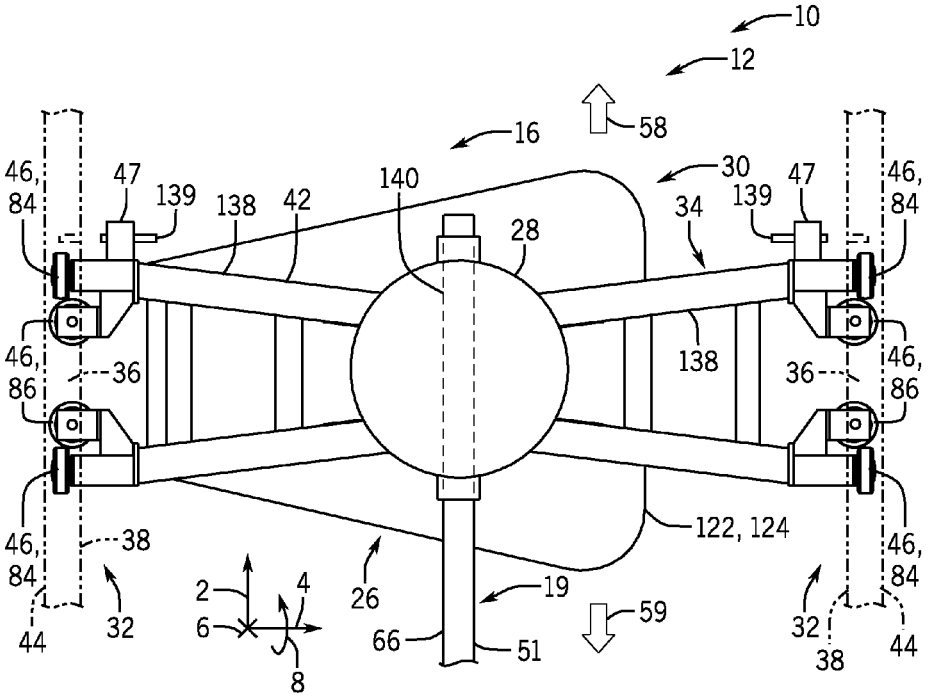
FIG. 7 is a schematic top view of an embodiment of the first rail guided structure taken within line 7-7 of FIG. 2, illustrating the rotational portion, the lift portion, and a plurality of wheels disposed along a pair of first rails.

The orientation of the components of the lift portion 26 and the rotational portion 28 may be further understood with respect to FIGS. 6 and 7. FIG. 6 is a partial cutaway schematic view of an embodiment of the lift portion 26 taken within line 6-6 of FIG. 5, illustrating the first stabilizing guide 123, 125 disposed in the slot 136 of the spreader bar 24 and the second and third stabilizing guides 123, 126, 127 disposed on the opposite sides 135, 137 of the spreader bar 24. In particular, FIG. 6 illustrates the second plate 124 from a plane between the first and second plates 122, 124, cut through the stabilizing guides 123, and looking downwardly on the second plate 124 and the spreader bar 24. As illustrated, the stabilizing guides 123 (e.g., 125, 126, 127) extend movably through the stabilizing guide supports or receptacles 128 in the triangular arrangements 121, 129, which helps to increase stability of the lift portion 26 during lifting and lowering. The first and/or second plates 122, 124 also may have a triangular shape as illustrated, or a rectangular shape, a circular shape, an oval shape, or a combination thereof. In the illustrated embodiment, the first stabilizing guide 123, 125 is disposed on a first end portion (e.g., a tip portion or reduced width portion) of the second plate 124, while the second and third stabilizing guides 123, 126, 127 are both disposed at a longitudinal offset away from the first stabilizing guide 123, 125 on a second end portion (e.g., an enlarged width portion) of the second plate 124. The first stabilizing guide 123, 125 may be sized to fit closely within the slot 136 and the guide supports or receptacles 128 to improve stability, while leaving sufficient clearance to enable movement up and down in the vertical directions 64, 65. Similarly, the second and third stabilizing guides 123, 126, 127 may be sized to fit closely within the guide supports or receptacles 128 and spaced closely about a width of the spreader bar spreader bar 24 to improve stability, while leaving sufficient clearance to enable movement up and down in the vertical directions 64, 65. In the illustrated embodiment, the stabilizing guides 123 and the guide supports or receptacles 128 have a circular cross-section or cylindrical shape. In some embodiments, the stabilizing guides 123 and the guide supports or receptacles 128 may be rectangular, square, triangular, oval, hexagonal, circular, or any combination thereof.

FIG. 7 is a schematic top view of an embodiment of the first rail guided structure 34 taken within line 7-7 of FIG. 2, illustrating the rotational portion 28, the lift portion 26, and the plurality of wheels 46 disposed along the pair of first rails 36. As illustrated, the first framework 42 (e.g., spider trolley) has a plurality of structural supports 138 diverging outwardly from the rotational portion 28 toward the pair of first rails 36 (e.g., first and second pairs of V-shaped structures defining an X-shaped structure). The first framework 42 supports a plurality of sets of wheels 46 on each of the pair of first rails 36, thereby helping to improve stability and movement of the first rail guided structure 34 along the first rails 36. For example, each of the structural supports 138 may include a plurality of wheels 46, such as one or more vertical wheels 84 and one or more horizontal wheels 86, disposed in the adjacent first rail 36. In addition, one or more of the structural supports 138 may include the lock assembly 47, which may have a movable lock structure 139 that selectively extends into the first rail 36 as indicated by dashed lines, and selectively retracts out of the first rail 36 as indicated by solid lines. The control system 20 may be communicatively coupled to each of the lock assemblies 47, thereby selectively controlling actuation of the movable lock structures 139 via a drive (e.g., an electric drive, a fluid drive, a solenoid, or any combination thereof). As discussed in detail above, when the lock assemblies 47 secure the first rail guided structure 34 relative to the first rails 36, the drive 17, 50 may rotate the threaded shaft 66 along a threaded receptacle 140, thereby driving the sliding support structure 68 as shown in FIG. 1. When the lock assemblies 47 release the first rail guided structure 34 relative to the first rails 36, the drive 17, 50 may rotate the threaded shaft 66 along the threaded receptacle 140, thereby driving the first rail guided structure 34 along the first rails 36 as shown by arrows 58, 59.

Figure 8:
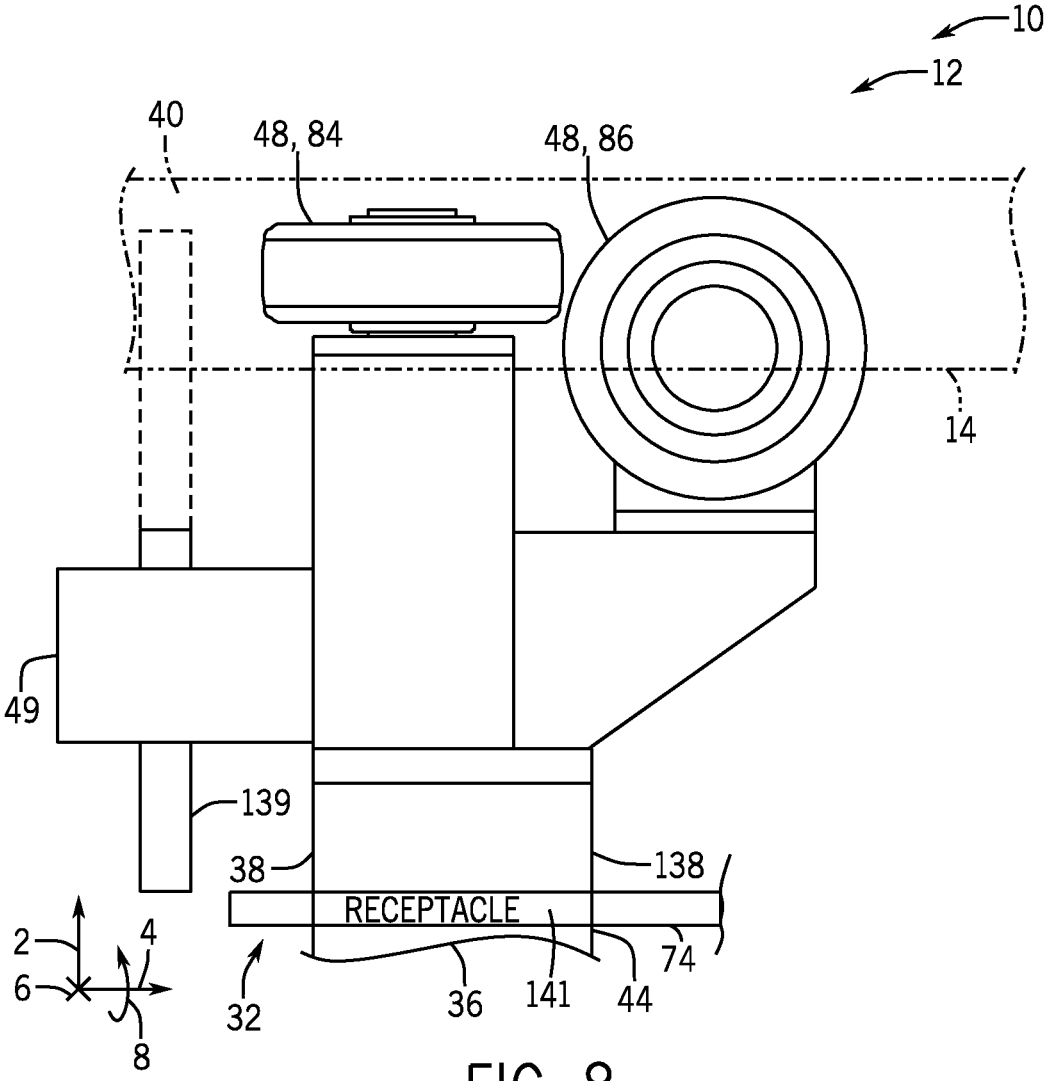
FIG. 8 is a partial schematic top view of an embodiment of the second rail guided structure taken within line 8-8 of FIG. 1, illustrating a plurality of wheels disposed along one of a pair of second rails.

FIG. 8 is a partial schematic top view of an embodiment of the second rail guided structure 38 taken within line 8-8 of FIG. 1, illustrating a plurality of wheels 48 disposed along one of a pair of second rails 40. As illustrated, the second framework 44 has a plurality of structural supports 138 that extend to the second rails 40, wherein each support 138 may include a set of wheels 48 (e.g., one or more vertical wheels 84 and one or more horizontal wheels 86) to improve stability and movement of the second rail guided structure 38 along the second rails 40. In addition, one or more of the structural supports 138 may include the lock assembly 49, which may have a movable lock structure 139 that selectively extends into the second rail 40 as indicated by dashed lines, and selectively retracts out of the second rail 40 as indicated by solid lines. The control system 20 may be communicatively coupled to each of the lock assemblies 49, thereby selectively controlling actuation of the movable lock structures 139 via a drive (e.g., an electric drive, a fluid drive, a solenoid, or any combination thereof). As discussed in detail above, when the lock assemblies 49 releases the second rail guided structure 38 relative to the second rails 40, the drive 17, 52 may rotate the transmission 19, 53 which can be also another threaded shaft 74 along a threaded receptacle 141, thereby driving the second frame or support structure 44 (as shown in FIG. 1) to a translational movement as shown with arrows 60, 61.

Figure 9:
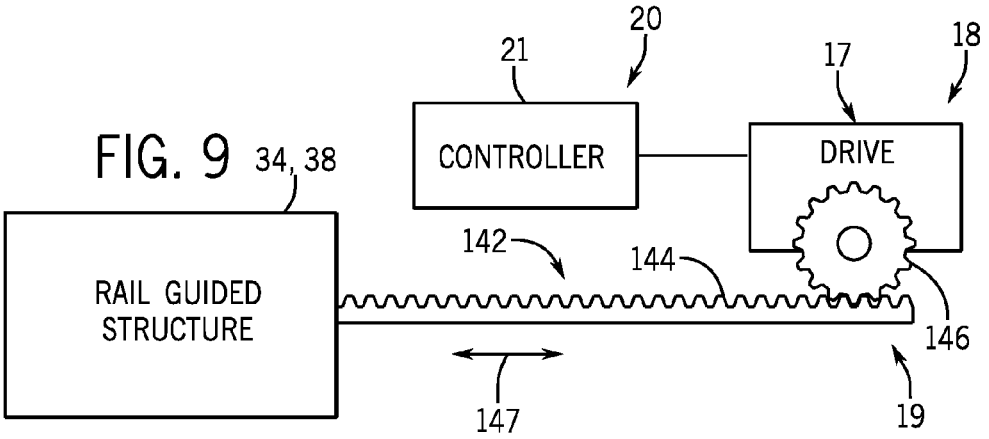
FIG. 9 is a diagram of an embodiment of the first and/or second rail guided structure and a drive system having a drive coupled to a rack and pinion.
Figure 10:
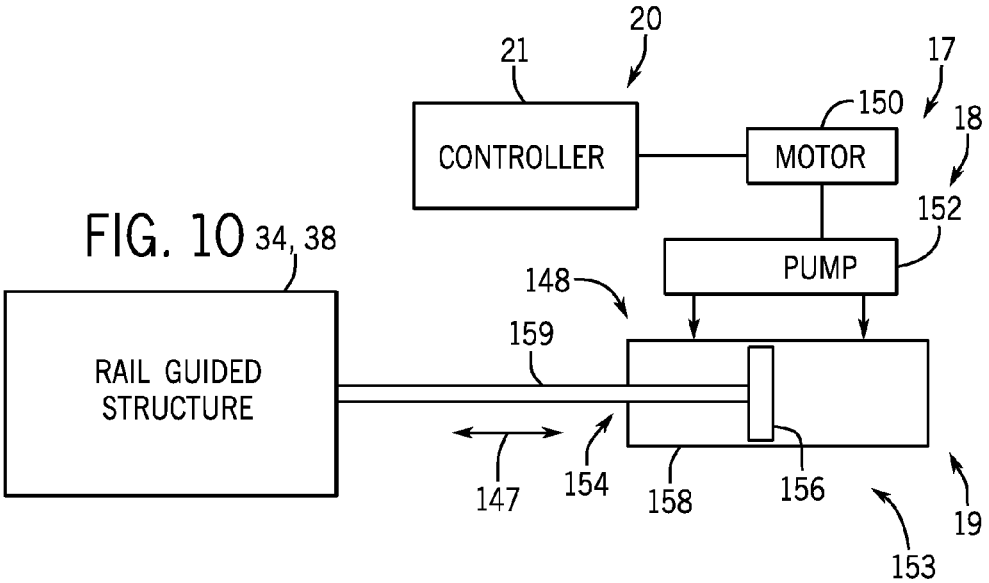
FIG. 10 is a diagram of an embodiment of the first and/or second rail guided structure and a drive system having a motor, a pump, and a fluid driven assembly.
Figure 11:
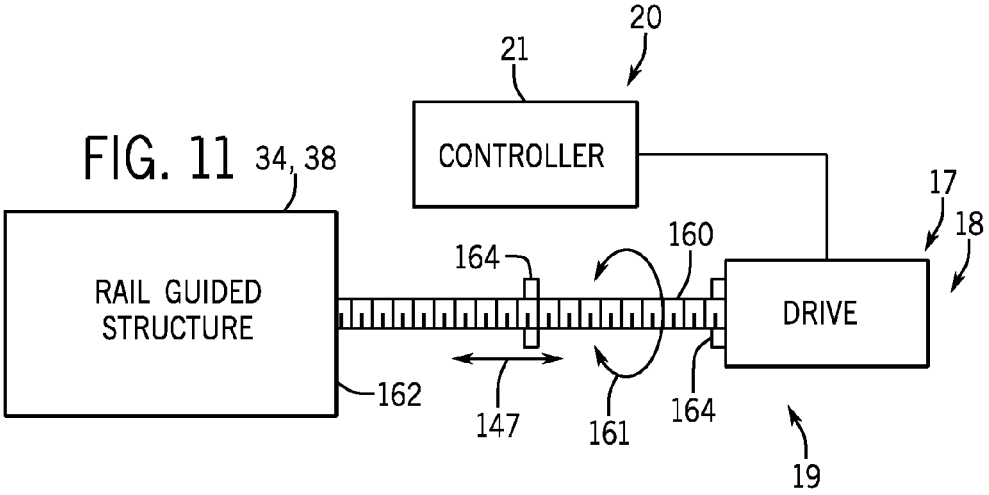
FIG. 11 is a diagram of an embodiment of the first and/or second rail guided structure and a drive system having a drive coupled to a rotary screw.

FIGS. 9-11 are diagrams of embodiments of the rail guided structure 34, 38, the drive system 18, and the transmission 19 as illustrated in FIGS. 1-8. In each embodiment, the drive system 18 (e.g., drive 17) is configured to selectively move the rail guided structure 34, 38 via movement (e.g., axial movement, rotational movement, or a combination thereof) of the transmission 19. The transmission 19 may include a track, a guide, a rod or shaft, a threaded shaft, a gear, a geared structure, a rack and pinion assembly, a worm and worm gear assembly, a piston and cylinder assembly, a chain, a cable, or any combination thereof. The drive system 18 (e.g., drive 17) may create rotational or linear motion, which may be used to drive the transmission 19 via rotational motion, axial motion, or a combination thereof. The drive 17 may include a fluid drive (e.g., a pneumatic or hydraulic drive), an electric drive or motor, or any combination thereof.

FIG. 9 is a diagram of an embodiment of the first and/or second rail guided structure 34, 38 and the drive system 18 having the drive 17 coupled to a rack and pinion assembly 142. In the illustrated embodiment, the rack and pinion assembly 142 includes a linear gear or rack 144 and a circular gear or pinion 146 coupled to the drive 17 of the drive system 18. In operation, the drive 17 is configured to rotate the pinion 146, which in turn causes movement of the rack 144 in opposite first and second directions 147 depending on the direction of rotation. The rack 144 is coupled to the rail guided structure 34, 38, and thus movement of the rack 144 causes movement of the rail guided structure 34, 38 in the directions 147.

FIG. 10 is a diagram of an embodiment of the first and/or second rail guided structure 34, 38 and the drive system 18 having a fluid drive 148 with a motor 150 (e.g., an electric motor) and a pump 152 driven by the motor 150, and the transmission 19 having a fluid driven assembly 153 driven by fluid from the pump 152. In the illustrated embodiment, the fluid driven assembly 153 includes a piston-cylinder assembly 154 fluidly coupled to the pump 152. The piston-cylinder assembly 154 includes a piston 156 disposed in a cylinder 158, wherein the piston 156 is further coupled to a shaft 159. In operation, the controller 21 may control the motor 150 to drive the pump 152, which in turn pumps a fluid (e.g., liquid or gas) into the cylinder 158 of the piston-cylinder assembly 154. The fluid then drives the piston 154 to move in one of the directions 147, thereby driving the rail guided structure 34, 38 in one of the directions 147. For example, fluid pumped into the right hand side of the cylinder 158 causes the piston 154, the shaft 159, and the rail guided structure 34, 38 to move in the leftward direction 147. Alternatively, fluid pumped into the left hand side of the cylinder 158 causes the piston 154, the shaft 159, and the rail guided structure 34, 38 to move in the rightward direction 147. The controller 21 may be configured to vary the speed of the motor 150 and pump 152, thereby varying the speed of movement of the piston 154 and rail guided structure 34, 38. For example, the controller 21 may operate the fluid drive 148 at a first speed during a first stage of movement, a second speed during a second stage of movement, and a third speed during a third stage of movement, wherein the first, second, and third speeds are progressively greater or lesser than one another.

FIG. 11 is a diagram of an embodiment of the first and/or second rail guided structure 34, 38 and the drive system 18 having the drive 17 coupled to a rotary screw or threaded shaft 160 of the transmission 19. In the illustrated embodiment, the shaft 160 may be threaded into mating threads 162 (e.g., threaded receptacle) in the rail guided structure 34, 38, such that rotation 161 of the shaft 160 causes axial movement of the rail guided structure 34, 38 in one of the opposite directions 147. The drive 17 may include an electric motor, a fluid drive, or any combination thereof, configured to rotate the shaft 160. In certain embodiments, the transmission 19 may include a worm and worm gear assembly. The drive system 18 also may include a plurality of bearings 164 disposed about the threaded shaft 160, e.g., in non-threaded portions of the shaft 160.

Technical effects of the disclosed embodiments include a load moving machine 12 having a frame 14 and a movable assembly 16 coupled to the frame 14, wherein the moveable assembly 16 is configured to move the load 11 in a plurality of directions (e.g., first and second horizontal directions, vertical directions, and rotational directions about one or more axes). These four degrees of freedom enable the load 11 to be balanced, be lifted, lowered, moved, or otherwise translated to dynamically move the load 11. The load moving machine 12 also includes a plurality of stabilizing structures to help resist undesired movement, rotation, tilting, pivoting, or any combination thereof, during a controlled movement by the drive system 18, the transmission 19, and the control system 20.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a load moving machine, comprising:

a frame; and a movable assembly coupled to the frame, wherein the movable assembly comprises a lift portion, a rotational portion, a first translational portion, and a second translational portion; wherein the rotational portion comprises first and second portions disposed coaxial relative to one another.

2. The system of claim 1, wherein the movable assembly comprises a spreader bar coupled to the movable assembly, and the spreader bar comprises one or more load couplings.

3. The system of claim 2, wherein the spreader bar comprises a slot extending lengthwise along the spreader bar, the lift portion comprises a first stabilizing guide disposed in the slot, and the lift portion comprises second and third stabilizing guides disposed outside of the slot on opposite sides of the spreader bar.

4. The system of claim 1, wherein the lift portion comprises a hoist having a spool, a drive coupled to the spool, and a cable disposed about the spool and coupled to a lift coupling.

5. The system of claim 1, wherein the lift portion comprises a telescopic joint having a plurality of concentric sleeves configured to extend and retract relative to one another.

6. The system of claim 1, wherein the lift portion comprises a plurality of stabilizing guides of a first plate movably disposed in a plurality of stabilizing receptacles of a second plate, and the lift portion is configured to move the first and second plates toward and away from one another.

7. The system of claim 1, wherein the lift portion is coupled to the rotational portion, the lift portion comprises a first drive, and the rotational portion comprises a second drive.

8. The system of claim 1, wherein the second portion is configured to rotate relative to the first portion, the first portion is coupled to the first translational portion, and the second portion is coupled to the lift portion.

9. The system of claim 1, wherein the first translational portion comprises a first rail guided structure disposed along one or more first rails and the second translational portion comprises a second rail guided structure disposed along one or more second rails.

10. The system of claim 9, wherein the first rail guided structure comprises the lift portion, the rotational portion, and one or more first wheels disposed along each of a plurality of the first rails, wherein the second rail guided structure comprises a plurality of the second rails, wherein the second rail guided structure comprises one or more second wheels disposed along each of a plurality of the second rails.

11. The system of claim 10, wherein the one or more first wheels comprise first and second wheels oriented crosswise to one another, and the one or more second wheels comprise third and fourth wheels oriented crosswise to one another.

12. The system of claim 1, wherein the load moving machine is configured to balance a load while moving the load with the lift portion, the rotational portion, the first translational portion, and the second translational portion.

13. The system of claim 1, comprising a controller coupled to one or more drives of the lift portion, the rotational portion, the first translational portion, or the second translational portion, wherein the controller is configured to control movement of a turbomachine.

14. A system, comprising:

a load moving machine comprising a movable assembly coupled to a frame, wherein the movable assembly comprises:

a spreader bar coupled having one or more load couplings;

a lift portion coupled to the spreader bar, wherein the lift portion comprises a first drive configured to raise and lower the spreader bar in a vertical direction;

a rotational portion coupled to the lift portion, wherein the rotational portion comprises a second drive configured to rotate the lift portion and the spreader bar;

a first translational portion comprising a third drive configured to translate the rotational portion, the lift portion, and the spreader bar in a first horizontal direction; and a second translational portion comprising a fourth drive configured to translate the rotational portion, the lift portion, and the spreader bar in a second horizontal direction crosswise to the first horizontal direction.

15. The system of claim 14, wherein the second translational portion comprises the fourth drive configured to translate the first translational portion.

16. The system of claim 14, wherein the load moving machine is configured to balance a load on the spreader bar.

17. A system, comprising:

a load moving machine, comprising:

a frame;

a movable assembly coupled to the frame, wherein the movable assembly comprises a lift portion, a rotational portion, a first translational portion, and a second translational portion; and at least one of:

a.) a spreader bar coupled to the movable assembly, wherein the spreader bar comprises one or more load couplings, and a slot extending lengthwise along the spreader bar, and the lift portion comprises a first stabilizing guide disposed in the slot;

b.) the lift portion comprising a hoist having a spool, a drive coupled to the spool, and a cable disposed about the spool and coupled to a lift coupling;

c.) the lift portion comprising a plurality of stabilizing guides of a first plate movably disposed in a plurality of stabilizing receptacles of a second plate, and the lift portion is configured to move the first and second plates toward and away from one another; or d.) the rotational portion comprising first and second portions disposed coaxial relative to one another.

18. The system of claim 17, comprising the spreader bar coupled to the movable assembly, wherein the spreader bar comprises one or more load couplings, and the slot extends lengthwise along the spreader bar, and the lift portion comprises the first stabilizing guide disposed in the slot.

19. The system of claim 17, wherein the lift portion comprises the hoist having the spool, the drive coupled to the spool, and the cable disposed about the spool and coupled to the lift coupling.

20. The system of claim 17, wherein the lift portion comprises the plurality of stabilizing guides of the first plate movably disposed in the plurality of stabilizing receptacles of the second plate, and the lift portion is configured to move the first and second plates toward and away from one another.

* * * * *